United States Patent [19]

Asano et al.

[11] 4,157,621

[45] Jun. 12, 1979

[54] METHOD FOR THE PREVENTION OF SLAKING OF DOLOMITE BRICKS

[75] Inventors: Sadame Asano; Masahiro Hayase, both of Taiyo; Hiromasa Tabuchi, Fukuyama; Masao Takagi, Tokyo; Koichi Kasai, Yokohama; Koei Hoshino, Choshi; Suejiro Fukuya, Kyushu; Hiroaki Hirahara, Sawara, all of Japan

[73] Assignees: Shinagana Refractories Co. Ltd.; Sumito Metal Industries, Ltd., Japan

[21] Appl. No.: 846,118

[22] Filed: Oct. 27, 1977

[30] Foreign Application Priority Data

Oct. 28, 1976 [JP] Japan ..... 51-128822

[51] Int. Cl.[2] ..... F26B 7/00

[52] U.S. Cl. ..... 34/13; 264/30

[58] Field of Search ..... 34/12, 13; 264/30

[56] References Cited

U.S. PATENT DOCUMENTS

| | | | |
|---|---|---|---|
| 1,541,147 | 6/1925 | Ikeda et al. | 34/13 X |
| 3,673,288 | 6/1972 | Childs, Jr. | 264/30 |

OTHER PUBLICATIONS

Page 162 of Modern Refractory Practice, Second edition, Copyright 1937 by Harbison-Walker Refractories Co., Pittsburgh, Pennsylvania.

*Primary Examiner*—John J. Camby

*Attorney, Agent, or Firm*—Brady, O'Boyle & Gates

[57] ABSTRACT

A method for preventing installed dolomite refractory and magnesia-dolomite refractory from slaking by feeding a dry air into a converter or the like after it was installed with said dolomite refractory and said magnesia-dolomite refractory, circulating the dry air in and through the converter while always maintaining the interior of the converter or the like under positive pressure.

1 Claim, 3 Drawing Figures

METHOD FOR THE PREVENTION OF SLAKING OF DOLOMITE BRICKS

This invention relates to a method for the prevention of slaking of dolomite bricks (including magnesia-dolomite brick) and, more particularly slaking of dolomite bricks which semi-stable clinker made of natural dolomite or synthetic dolomite is used. Generally dolomite bricks are separated into three kinds: tar-dolomite brick, stable, burned dolomite brick and semi-stable, burned dolomite brick. Tar-dolomite brick has a low strength against high temperature, and stable, burned dolomite brick is added with additives (such as $SiO_2$, $Al_2O_3$ and $Fe_2O_3$) because it completely stabilizes free lime so that it is inferior on high temperature properties and corrosion resistancy. These are the demerits of the tar-dolomite brick and the stable, burned dolomite brick. To the contrary, semi-stable, burned dolomite brick has increased its use ratio year by year as brick for overcoming the disadvantages of said bricks.

Since the semi-stable, burned dolomite brick is expensive, however, the converter is lined generally in such manner that the total merit is induced by effecting a zoned lining with the tar-dolomite brick or the stable, burned dolomite brick. In the converter where operation conditions are not so severe there is sometimes used tar-dolomite brick to an extent of 95%. Further, thanks to a slag control by calcined dolomite and the repair of the inside walls of the converter by means of hot gunning, the converter life has been rapidly prolonged these days.

Due to the rapid progress of the converter life there have become very important the decision of starting time for laying bricks in a waiting converter and the prevention of slaking of bricks after the installation of the converter. These are important particularly in the summer in a converter where tar-dolomite bricks are used. Because of the progressed slaking of bricks after completion of the installation it is often required that a waiting converter is started for operation by stopping the operation of the converter under operation, though the converter is still operable, or that tentatively the waiting converter must be operated, thereby producing a tremendous loss.

To prevent bricks after the completion of the installation from slaking there has conventionally been effected a method for the maintenance of the converter, in which the surfaces of the bricks are coated with tar, resin or the like, calcined lime or other desiccant is charged into the converter and a cover is applied. However, this method is not sufficient.

The object of the present invention is to prevent the dolomite bricks after the completion of installation from slaking, and the invention relates to a method of feeding a dry air into the converter after completion of installation, the air being obtained by using a desiccant, either in granulation or moulded, which has demoistening effect, and circulating this dry air in the converter while maintaining the interior of the converter always under positive pressure during the feeding and circulation process.

In order that the invention may be more clearly understood some embodiments thereof will be described though not to be construed as limiting the scope of the invention, by way of example, with reference to the accompanying drawings, in which.

Slaking of dolomite brick occurs because the free CaO in dolomite reacts with water content principally in the air to change into $Ca(OH)_2$. The more the water content in the air is, or the higher the temperature is, the more frequently said reaction occurs i.e. the slaking takes place. To prevent the slaking, therefore, it is required either to decrease the water content in the air or lower the temperature of air or to effect these operations at one time.

Figure 1:
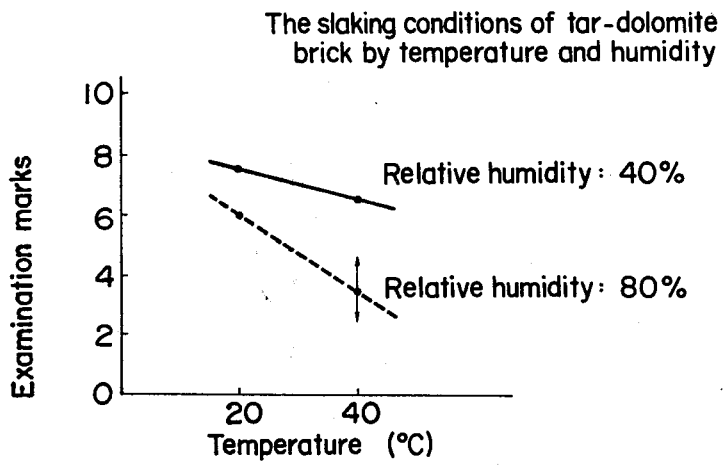
FIG. 1 is a graph showing the slaking conditions of dolomite brick by way of temperature and relative humidity, the full line showing a case of 40% relative humidity and the broken line a case of 80% relative humidity respectively.

The inventors of this invention investigated the degree of deterioration (slaking) of dolomite brick by keeping the temperature and humidity uniform, to obtain the result shown in FIG. 1.

The numerals of examination marks in FIG. 1 express an appearance deterioration, being obtained according to the following marking method.

| Examination Marks | Affection State by Appearance |
|---|---|
| 10 | The appearance did not change. |
| 8–9 | The cutting face changed brown. |
| 6–7 | The cutting face was powdered a little. |
| 5 | The surface was powdered (spot-like) a little. |
| 3–4 | Partially powdered. |
| 1–2 | The configuration got out of shape. |
| 0 | No shape. |

Figure 2:
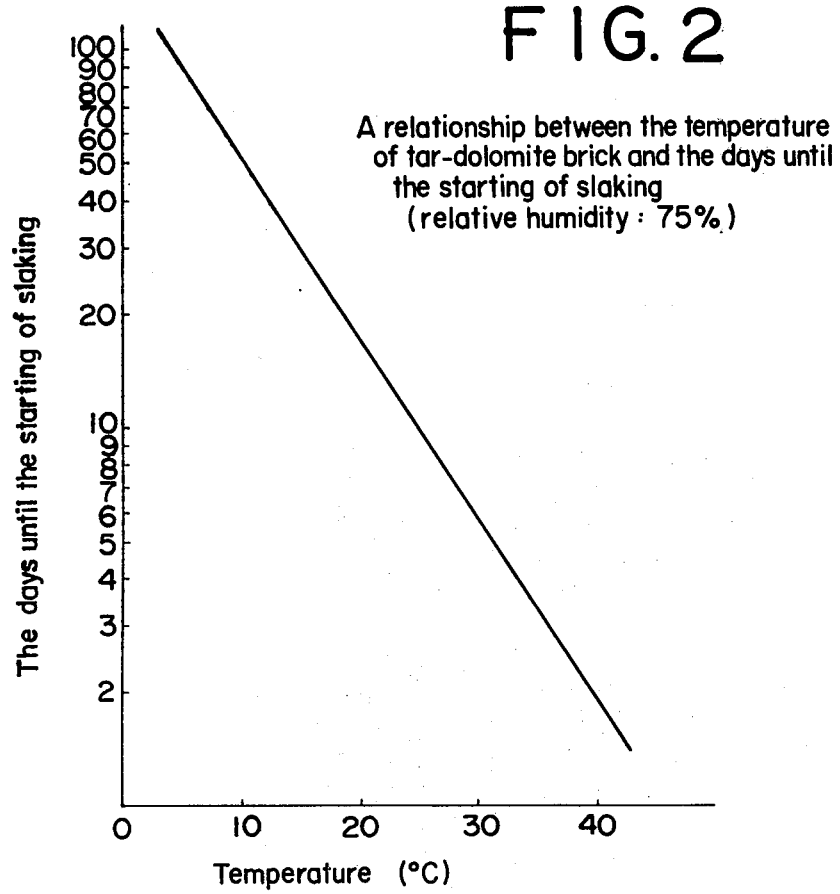
FIG. 2 is a graph showing a relationship between the temperature of tar-dolomite brick and the days until the starting of slaking.

Further, as shown in FIG. 2 are the days until a commencement of slaking of tar-dolomite bricks at the condition of 75% relative humidity.

It will be understood from FIG. 1 that the higher the temperature becomes, the greater the relative humidity (the water content in the air) gives influence upon slaking. This shows that if only the relative humidity (the water content in the air) is decreased, slaking does not occur even at high temperature by contraries. Also it will be understood from FIG. 2 that the temperature must be maintained below 12° C. to store, for example for 40 days, the bricks after the completion of converter installation. Moreover, the absolute humidity in the air at the time when the temperature is 12° C. and the relative humidity 75%, is 8.0 g/m$^3$, and in order to store the bricks for 40 days it is necessary to keep the absolute humidity below 8.0 g/m$^3$.

The period required for the storage of bricks after a converter was installed varies according to the use method or conditions of the converter so that it is difficult to maintain uniform the temperature conditions and the humidity conditions in the air. For instance, if the bricks must be stored for six months it may be required to keep the temperature of the air 0° C. and the relative humidity near 0%. Further, in case only one month storage is necessary it will suffice to make the air temperature 15° C., the relative humidity 75% and the absolute humidity 10 g/m$^3$. Provided that the relative humidity and the absolute humidity 6.5 g/m$^3$ can be retained below 5% the bricks can be sufficiently stored even if the temperature is raised up to about 60° C.

That is, the most suitable air conditions for the brick storage are to retain both the temperature and humidity low, but it is possible to store the bricks with safety during the period necessary for storage by keeping either of the temperature and the humidity low, and the air conditions therefor are in the range of temperature 0°–60° C., relative humidity 0–40% and less than absolute humidity 10 g/m$^3$. The air in the range under such conditions is called dry air in the present invention.

Although the principal object of the present invention is to prevent the slaking of dolomite bricks and magnesia-dolomite bricks in the converter after the completion of the installation, the invention may be easily applied for the keeping of the bricks before installation and of the residual bricks after installation. That is, because of likely slaking the dolomite bricks are, in many cases, strictly packed generally by tin plate, aluminium foil, vinyl, polyethylene or the like, and in the package there is additionally employed a desiccant or the like. Accordingly, if bricks are stored in an air-tight warehouse and a dry air is fed thereinto to maintain the bricks before converter installation, packaging will be simplified. In addition, the residual bricks after the installation of a converter are very often disposed of without being used for a subsequent converter because of slaking, but with the use of the present invention it is possible to safely store said bricks and use them for the subsequent converter. Compared with the storage by cold temperature warehouse, which is conventionally, generally carried out, the method of the invention is simple in operation and administration, and low in operation cost.

Figure 3:
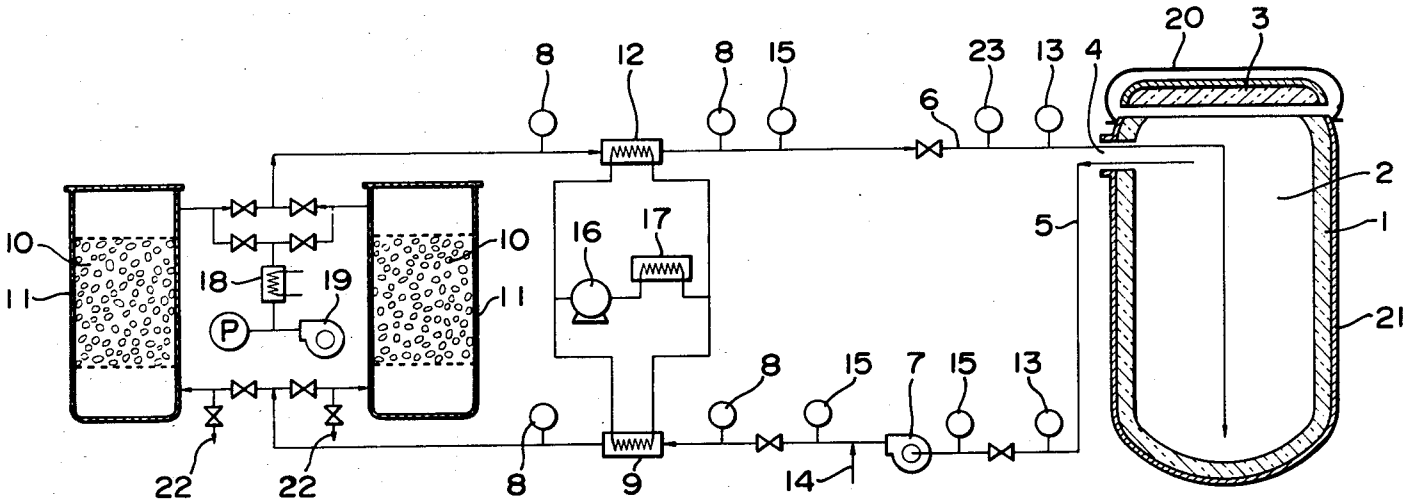
FIG. 3 is a schematic view of the concrete method for carrying out the present invention.

One embodiment of the invention will now be described with reference to FIG. 3.

A converter body 2 lined with dolomite bricks 1 is covered with a cover 3 which is further covered with a sheet 20. A suction pipe 5 and a blow pipe 6 are inserted into a tap hole 4. Piping arrangement is made in such manner that the mouth of the suction pipe 5 is at the same height as or higher than the tap hole, and the mouth of the blow pipe 6 is close to the converter bottom. The air within the converter is sucked by a blower 7. Midway said suction pipe 5 there are arranged hygrometers 8, a cooler 9, a dew point detector 13 and pressure gauges 15.

The air sucked by said blower 7 is dewatered at adsorbing towers 11 which are filled with alumina silica gel 10, (said towers being arranged in parallel and resuscitated for their alternate use). The air is then cooled by a cooler 12 and guided into the converter by the blow pipe 6. Midway said blow pipe 6 there are mounted hygrometers 8 to indicate the dry status of the air, and further, a dew point detector 13 and a pressure gauge 15.

In addition, to avoid an entry of wet air from the outside of the converter into the converter, an open air of about 1/20 of the total circulating air quantity is added from a pipe 14 provided just before the blower 7, thereby maintaining the inside of the converter under positive pressure. In the drawing the reference numerals 15 designate pressure gauges, the numeral 16 a compressor for refrigerator, the numeral 17 a condenser for refrigerator, and the reference 18 a heater for the resuscitation of the adsorbing tower respectively. The reference 19 shows a blower for the resuscitation of the adsorbing tower, the reference 21 an iron shell for the converter body itself, the references 22 discharge pipes of the resuscitation circuit of said adsorbing towers, and the numeral 23 a thermometer respectively.

EXAMPLE

For the purpose of preventing the tar-dolomite bricks from slaking after the installation of a 250T converter it was continued to feed a dry air of the relative humidity 0% and 25° C. into the converter by 1.5 m$^3$/min. by using a desiccant based on alumina silica gel, after the completion of the installation. The dry air conditions in the blowing hole were such that the relative humidity was 0% and the temperature 25° C. In carrying out the operation there was adopted the so-called closed circuit in which the air is sucked out of the converter and then it is fed into the converter, to economize the use amount of the desiccant. Moreover, taking a leakage of air into the converter into consideration, open or ambient air by about 1/20 of the suction air quantity was added so that the inside of the converter may be under a slight positive pressure. As a result there were obtained the distinctive effects as shown in the following Table.

| | Results | |
|---|---|---|
| | Present method | Conventional method |
| Temperature within the converter | 35° C. | 35° C. |
| Relative humidity within the converter | 5% | 75% |
| Period before starting of slaking | More than 40 days | 10 days |

What we claim is:

1. A method for the prevention of slaking of dolomite and/or magnesia-dolomite refractory lining comprising:

blowing dry air which is in the temperature range of 0°–60° C., relative humidity range of 0°–40%, and which has an absolute humidity less than 10 g/m$^3$ into a sealed converter or the like lined with dolomite refractory and/or magnesia-dolomite refractory, circulating said dry air in the converter, and maintaining the interior of the convertor always under positive pressure during the blowing and circulating steps.

* * * * *

UNITED STATES PATENT AND TRADEMARK OFFICE

CERTIFICATE OF CORRECTION

PATENT NO. : 4,157,621

DATED : June 12, 1979

INVENTOR(S) : SADAME ASANO, MASAHIRO HAYASE HIROMASA TABUCHI, MASAO TAKAGI, KOICHI KASAI, KOEI HOSHINO, SUEJIRO FUKUYA & HIROAKI HIRAHARA

It is certified that error appears in the above-identified patent and that said Letters Patent are hereby corrected as shown below:

In the Heading of the Patent, at [73], the names of the Assignees are changed from "SHINAGANA REFRACTORIES CO. LTD.; SUMITO METAL INDUSTRIES, LTD., Japan" to --SHINAGAWA REFRACTORIES CO., LTD.; and SUMITOMO METAL INDUSTRIES, LTD., Japan--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*